United States Patent [19]

Sterling

[11] 4,385,278

[45] May 24, 1983

[54] TESTING APPARATUS FOR AN ELECTRONIC IGNITION SYSTEM FOR AN INTERNAL COMBUSTION ENGINE

[75] Inventor: Thomas B. Sterling, Glendale, Calif.

[73] Assignee: Auto-Equip, Inc., Torrance, Calif.

[21] Appl. No.: 266,823

[22] Filed: May 26, 1981

[51] Int. Cl.[3] ..... F02P 17/00

[52] U.S. Cl. ..... 324/381

[58] Field of Search ..... 324/381, 380, 383

[56] References Cited

U.S. PATENT DOCUMENTS

| | | | |
|---|---|---|---|
| 3,551,800 | 12/1970 | Widmer | 324/383 |
| 3,891,917 | 6/1975 | Harris | 324/383 X |
| 4,035,619 | 7/1977 | Cholet | 324/383 X |
| 4,064,450 | 12/1977 | Morales et al. | 324/383 |
| 4,101,822 | 7/1978 | Doss et al. | 324/381 |
| 4,186,337 | 1/1980 | Volk et al. | 324/380 |

*Primary Examiner*—Stanley T. Krawczewicz
*Attorney, Agent, or Firm*—Philip M. Hinderstein

[57] ABSTRACT

Testing apparatus for an electronic ignition system for an internal combustion engine, the electronic ignition system having an ignition coil with a spark output, an electronic control unit connected to the coil for controlling the coil output, a distributor, and a magnetic sensor coupled to the distributor and to the electronic control unit and responsive to rotation of a timing cam in the distributor for producing output pulses for controlling the electronic control unit operation. The testing apparatus includes a pulse generator for generating pulses at a desired variable rate, driver circuitry, and a trigger coil inductor responsive to the pulse generator for exciting the distributor's magnetic sensor, whereby the sensor generates pulses as if the engine were operating for controlling the electronic control unit and testing its operation.

7 Claims, 3 Drawing Figures

(a)
(b)
(c)
(d)
(e)
(f)
(g)
(h)
(i)
(j)
(k)
+
0
-
46
58
59
76
80
81
82
85
91
86
96

TESTING APPARATUS FOR AN ELECTRONIC IGNITION SYSTEM FOR AN INTERNAL COMBUSTION ENGINE

BACKGROUND OF THE INVENTION

1. Field of the Invention

The present invention relates to testing apparatus for an electronic ignition system for an internal combustion engine and, more particularly, to testing apparatus for dynamically driving electronic ignition systems throughout their entire RPM ranges.

2. Description of the Prior Art

Electronic ignition systems are becoming increasingly more popular in automobiles and other vehicles. By eliminating the mechanical points, they operate more dependably and accurately and for longer periods of time. On the other hand, these systems are extremely complex, are usually packaged in a single amplifier module, and are difficult for even a skilled mechanic to check and test. When the vehicle's engine malfunctions or ceases to operate, the electronic ignition system necessarily becomes suspect.

A mechanic can chose from a multiplicity of equipments to test almost every separate piece of each system installed on an engine, such as fuel, mechanical and electrical parts, with or without the engine running. However, there has been no way of testing the actual dynamic operation of the electronic ignition system unless the vehicle's engine is operating. Unfortunately, very often, the engine will not operate and it is difficult to isolate the source of the problem.

A number of attempts have been made to solve this problem. It has been proposed to simulate the actual operating conditions of an electronic ignition system to evaluate operation and isolate problems. One known system includes a trigger simulation device, including a trigger pulse generator and an amplifier, for externally simulating the trigger pulses generated by the distributor magnetic sensor. This pulse is then applied to the electronic ignition system and the operation of the system monitored. However, such system requires an external generator to simulate the operation of the engine and disconnection of the input connection from the distributor magnetic sensor to the electronic control unit.

U.S. Pat. No. 4,101,822 describes a self-contained, portable unit which does not require any auxiliary power supply for testing breakerless ignition systems. A simulator circuit is provided to simulate a signal representative of the signal obtained by the rotation of a timing cam as the timing cam traverses a magnetic sensor. Again, the approach of this patent is to bypass the magnetic sensor and to inject an artificial signal directly into the ignition system.

U.S. Pat. No. 4,186,337 also discloses testing apparatus for performing voltage, continuity, open circuit or dynamic signal substitution testing of each individual major component within an automotive-type transistor ignition system. However, in order to use this device, one must disconnect each component and separately simulate some signal to it, or receive some signal from it.

SUMMARY OF THE INVENTION

The present invention differs from all prior known devices because it does not simulate operation of any component within the engine electrical system. Rather, the present invention operates the electronic ignition system by dynamically exciting the magnetic or other sensor of the distributor so that the sensor generates pulses for application to the electronic control unit as if the engine were actually running. With such a system, no disconnection of parts or simulation of operation is required and an electronic ignition system can be operated over any RPM range, at any rate, and with any number of cylinders in operation.

Briefly, a testing apparatus for an electronic ignition system for an internal combustion engine, such electronic ignition system having an ignition coil with a spark output, an electronic control unit connected to the coil for controlling the coil output, a distributor, and a magnetic sensor coupled to the distributor and to the electronic control unit and responsive to rotation of a timing cam for producing output pulses for controlling the electronic control unit operation, comprises means for generating pulses at a desired rate; and means responsive to the pulse generating means for exciting the distributor magnetic sensor whereby the sensor generates pulses for controlling the electronic control unit for testing its operation.

OBJECTS, FEATURES, AND ADVANTAGES

It is therefore the object of the present invention to solve the problems encountered heretofor in testing apparatus for an electronic ignition system for an internal combustion engine. It is a feature of the present invention to solve these problems by providing testing apparatus for dynamically driving electronic ignition systems throughout their entire RPM ranges. An advantage is that the electronic ignition system is tested as if the engine were actually running. Another advantage is that no parts of the electronic ignition system need be disconnected. A further advantage is that complex signals for simulating system operation need not be generated. An additional advantage is that an electronic ignition system can be tested over any RPM range. Still another advantage is that an electronic ignition system with any number of cylinders can be tested.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
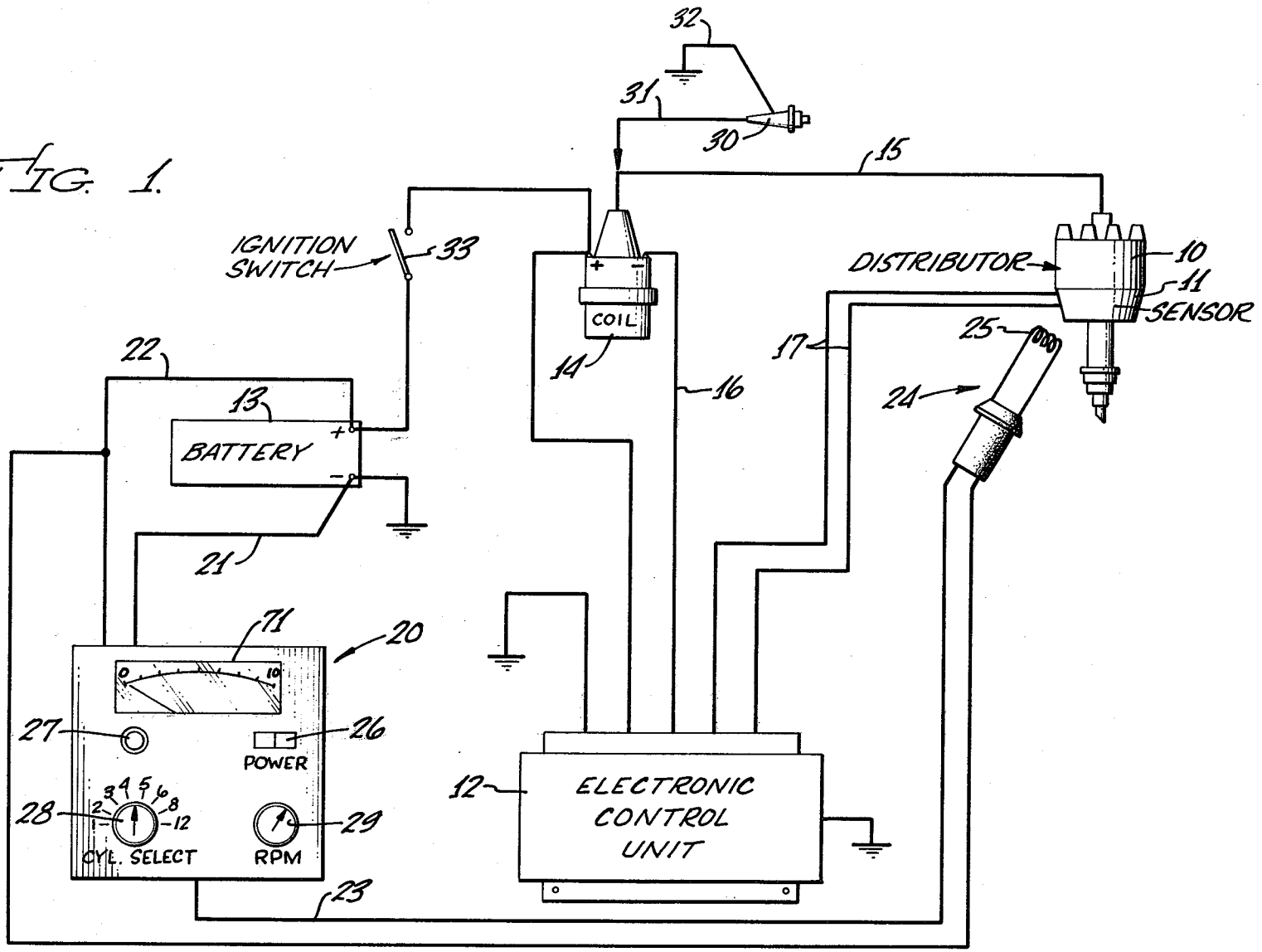
FIG. 1 is a block diagram representation of a typical automobile electronic ignition system illustrating the connection thereto of the present testing apparatus.

Referring now to the drawings and, more particularly, to FIG. 1 thereof, modern electronic ignition systems, often called transistor ignition systems, most often comprise four major components. A block representation of such an electronic ignition system shows a distributor 10 including a distributor sensor 11, an electronic control unit (ECU) 12, a battery 13, and an ignition coil 14 having a secondary winding wire 15. Sensor 11 typically includes a rotating timing cam mechanically coupled to the internal combustion engine, which determines when a pulse is to be provided to the spark plugs. Specifically, as the timing cam within distributor 10 rotates, lobes mounted thereon traverse the face of magnetic sensor 11. Detection of a lobe by sensor 11 generates an output pulse for controlling electronic control unit 12. Other types of sensors, including photo-optic sensors, are known to those skilled in the art. However, magnetic sensors are, by far, the most common type presently in use.

The heart of the electronic ignition system is the electronic control unit 12. ECU 12 acts as an electronic switch for controlling, via electrical connection 16, the flow of current received from battery 13 through the primary winding of ignition coil 14, electrical connection 16 being the return from the negative terminal of ignition coil 14. The operation of ECU 12 is triggered by the operation of distributor sensor 11. A signal generated within distributor sensor 11, as described previously, is transmitted via sensor signal wires 17 to trigger the operation of a transistor switch within ECU 12 to momentarily open the primary winding of coil 14 by interrupting the current flow of return connector 16. The momentary collapse of the field of the primary winding is transformed into an impulse on the secondary winding and transmitted to the spark plugs via secondary winding wire 15 and distributor 10.

The electronic ignition system of FIG. 1 may be tested by the present testing apparatus, generally designated 20. As shown in FIG. 1, testing apparatus 20 has first and second output leads 21 and 22 which are adapted to be connected to the negative and positive posts, respectively, of battery 13. In this manner, testing apparatus 20 is portable and self-contained and capable of being operated by the engine battery. Testing apparatus 20 has another output lead 23 which is connected to one terminal of a probe 24 which includes a trigger coil inductor 25. The other terminal of probe 24 is connected to line 22 and the positive post of battery 13.

Testing apparatus 20 includes an on/off switch 26, a status indicator lamp 27, a cylinder select switch 28, and an RPM adjust knob 29. All of these components will be described more fully hereinafter.

According to a preferred embodiment of the invention, the operation of ECU 12 under control of testing apparatus 20 is monitored by the use of a test spark plug 30. During testing of ECU 12, secondary winding wire 15 is preferably removed from the secondary of coil 14 and is replaced by a lead 31 connected to test spark plug 30. The ground connection of spark plug 30 is then grounded by a wire 32 connected to ground.

Figure 2:
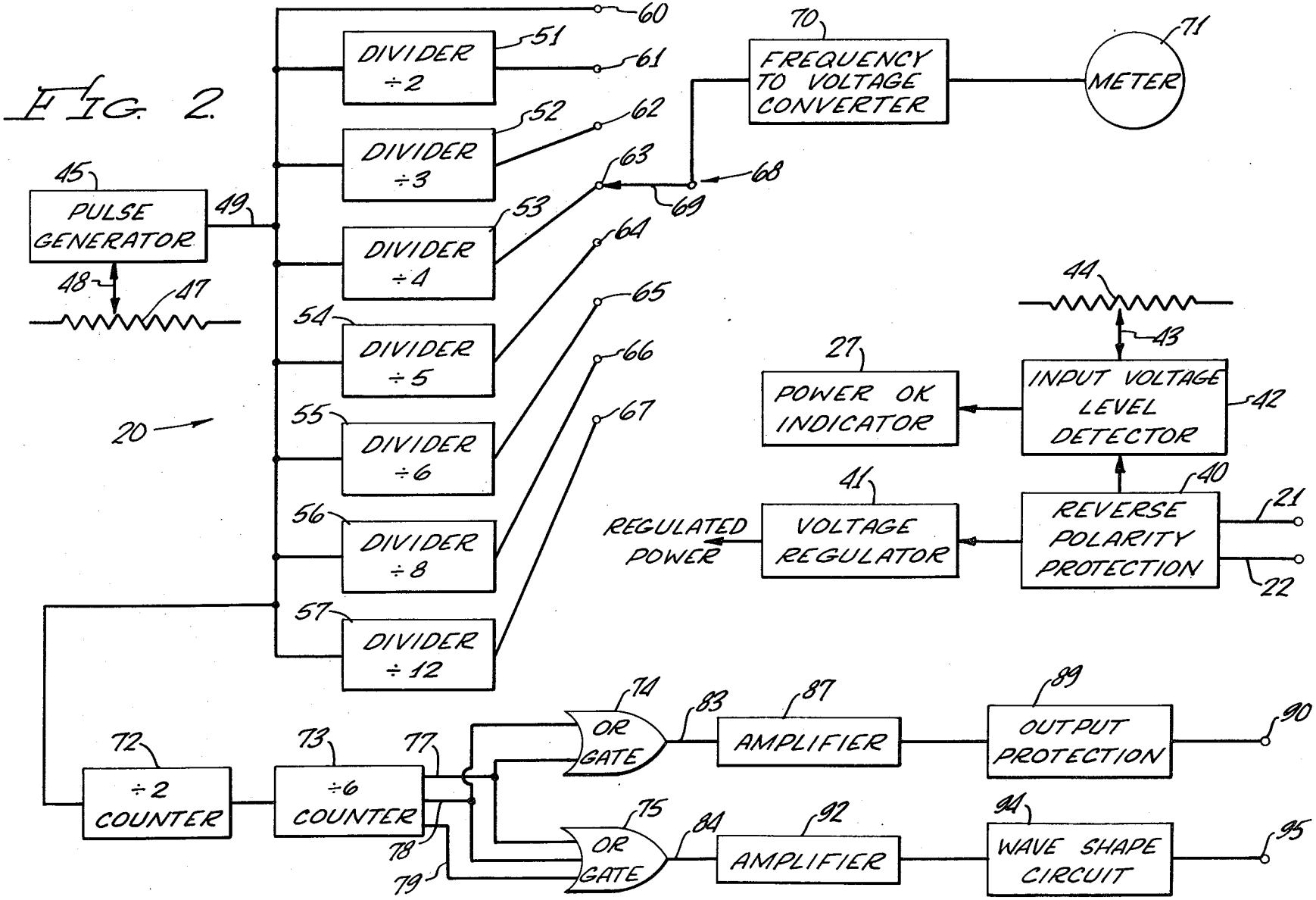
FIG. 2 is a block diagram of testing apparatus constructed in accordance with the teachings of the present invention.
Figure 3:
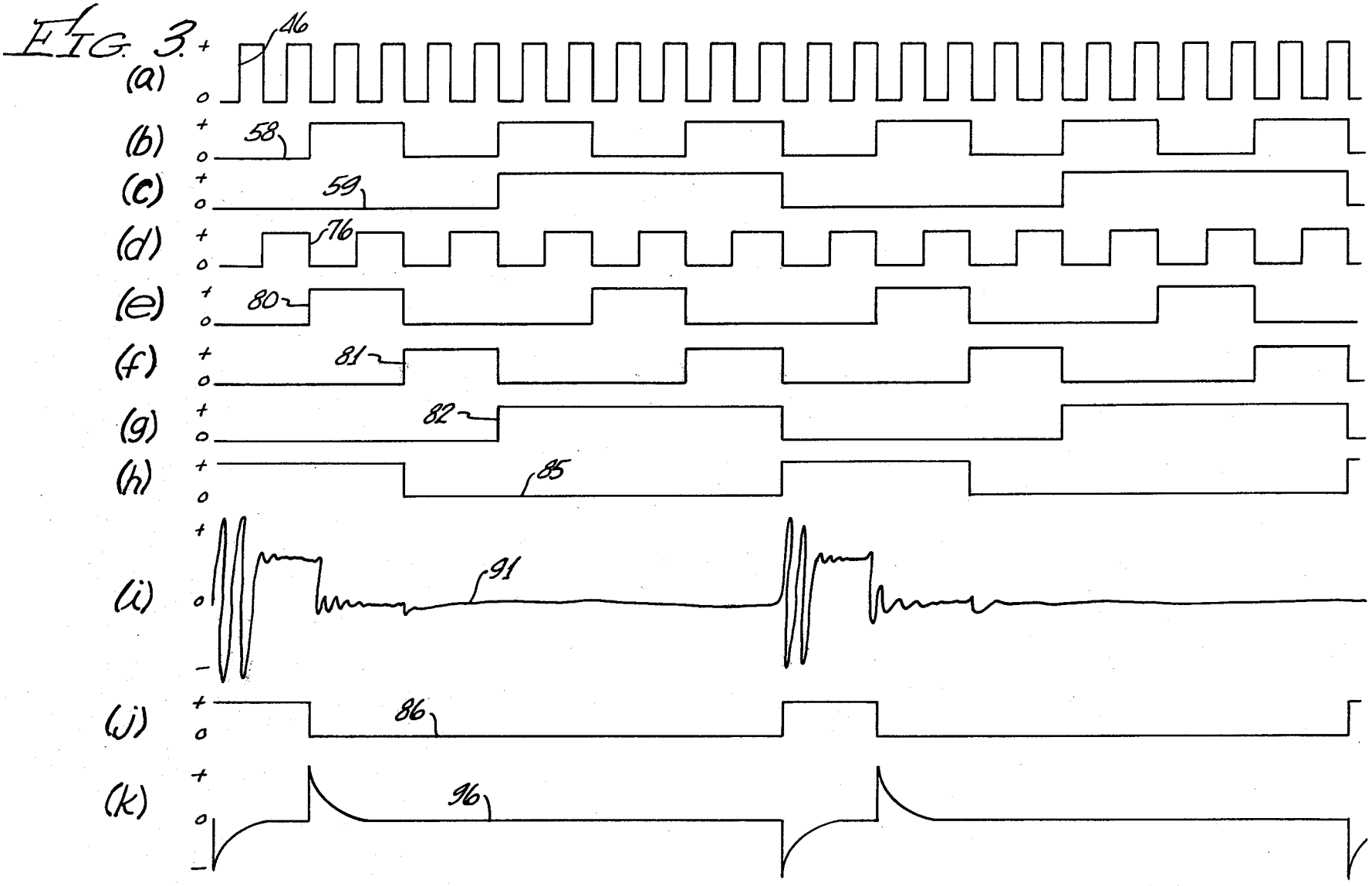
FIG. 3 is a series of waveforms useful in explaining the operation of FIG. 2.

Referring now to FIGS. 2 and 3, there is shown a block diagram of testing apparatus 20. Testing apparatus 20 is powered by vehicle battery 13 which results in a wide range of input voltages, sometimes as low as 8 or 9 volts, all the way up to 15 or 16 volts. Leads 21 and 22 are connected to a conventional reverse polarity protection circuit 40 which prevents damage to circuit components due to a reversal of leads 21 and 22. Circuit 40 applies the voltage to a voltage regulator 41 which drops the input voltage to a constant 5 volts to operate all of the circuits within apparatus 20. Circuit 40 also applies the input voltage to an input voltage detector 42 which receives a reference voltage over a line 43 from a potentiometer 44. Detector 42 simply monitors the input voltage and supplies current to power OK indicator lamp 27 only when the input voltage exceeds 10 volts. Lamp 27 will not light if leads 21 and 22 are reversed. Thus, lamp 27 will signal that apparatus 20 is connected properly to battery 13 and that there is sufficient voltage to operate the various circuit components. Potentiometer 44 is used to adjust for tolerances of other components in this section.

Testing apparatus 20 includes a pulse generator 45 which produces a square-wave signal 46, shown in FIG. 3(*a*), with an approximately 50% duty cycle. Pulse generator 45 receives an input from a potentiometer 47 having a movable arm 48 connected to RPM knob 29. Potentiometer 47 is used to adjust the output frequency of generator 45 so that ECU 12 can be tested over the entire operating range of the engine.

The output of pulse generator 45, on line 49, is connected to a plurality of divider circuits 51–57, whose outputs are connected to a series of terminals 61–67, respectively. Line 49 is also connected directly to a terminal 60. Each of circuits 51–57 divides the square wave by the amount indicated thereon. By way of example, the output of divider 53 is shown as waveform 58 in FIG. 3(*b*) and the output of divider 57 is shown as waveform 59 in FIG. 3(*c*).

Terminals 60–67 are part of a cylinder select switch 68 having an arm 69 which is operative to contact any of terminals 60–67 and is connected to switch 28 on the face of testing apparatus 20. As will be described more fully hereinafter, when arm 69 is connected to terminal 63, for example, testing apparatus 20 would be used for testing a four-cylinder, four-stroke engine. Similarly, moving arm 69 into contact with terminal 64 would render apparatus 20 useful for testing a five-cylinder, four-stroke engine. In any event, the signal on arm 69 is conducted to a frequency-to-voltage converter 70 which converts the digital signal into a voltage proportional to the frequency thereof. The output of converter 70 is applied to a meter 71 which also appears on the face of testing apparatus 20 to indicate to the mechanic the RPM at which the engine is being tested.

The use of dividers 51–57 is a significant advantage of apparatus 20 in that it provides the exact numerical ratio between the different engines, based on the number of cylinders, without the need for expensive calibration procedures or excess adjustment potentiometers required of conventional designs.

As explained previously, the output of pulse generator 45 is a square wave signal having an approximately 50% duty cycle. A signal having a 50% duty cycle is not desirable for testing ECU 12. Rather, for different purposes, it is desirable to have a one-third duty cycle and a one-sixth duty cycle. This will appear more fully hereinafter. Accordingly, testing apparatus 20 includes a first counter 72 responsive to the output of pulse generator 45 on line 49 for dividing the output of pulse generator 45 by two and a second counter 73 responsive to the output of counter 72 for dividing the output of counter 72 by six. The output of counter 73 is connected to a pair of OR gates 74 and 75.

As stated previously, the function of elements 72–75 is to provide an exact duty cycle even when the duty cycle of pulse generator 45 varies. Counter 72 preconditions the input of counter 73, the output of counter 72 being shown as waveform 76 in FIG. 3(*d*). Counter 73 has several taps, some of which are connected to the inputs of OR gates 74 and 75. Thus, counter 73 produces on lines 77, 78, and 79, the waveforms 80, 81, and 82, respectively, shown in FIGS. 3(*e*), (*f*), and (*g*), respectively. With the proper connection of OR gates 74 and 75, output duty cycles can be set for 1/6, $\frac{1}{3}$, $\frac{1}{2}$, $\frac{2}{3}$, or 5/6, while the output frequency remains 1/6th of the input frequency. 1/12th of the frequency of pulse generator 45.

The outputs of OR gates 74 and 75 on lines 83 and 84, respectively, are shown as waveforms 85 and 86, respectively, in FIGS. 3(*h*) and 3(*j*), respectively. It is seen that the output of OR gate 74 provides a duty cycle of $\frac{1}{3}$, which is 1/12th the frequency of pulse generator 45. The output of OR gate 75 provides a duty cycle of 1/6th, which is also 1/12th the frequency of pulse generator 45.

The significance of this will be apparent when it is viewed in light of dividers 51–57. That is, the outputs of gates 74 and 75 are used to drive electronic control unit 12, as will appear more fully hereinafter, at a fixed frequency which is determined by the output of pulse generator 45. This same output is utilized to drive meter 71 to indicate to the mechanic the speed at which ECU 12 is being operated. Obviously, this latter conversion is a function of the number of cylinders in the engine. Accordingly, for example, the output of pulse generator 45, when applied to divider 57, produces an output frequency on terminal 67 which is the same as the output frequencies of gates 83 and 84. This calibrates meter 71 for a 12 cylinder engine. As the number of cylinders decreases, the output of pulse generator 45 must be divided by a proportionately lower number in order to calibrate meter 71 to the output of gates 74 and 75. This is the function of dividers 51–57 and switch 68.

The output of OR gate 74 on line 83 is amplified by an amplifier 87 to a suitable output current level. The output of amplifier 87 is then conducted via an output protection circuit 89 to an output terminal 90. The output of circuit 89 has the same appearance as waveform 85 in FIG. 3(*h*). As will appear more fully hereinafter, this output drives a highly inductive load which requires protection circuit 89 to prevent damage to amplifier 87. Such protection circuit may be a fuse. The signal at output terminal 90 simulates the signal seen by sensor 11 in distributor 10 as the lobes of the timing cam traverse the face of sensor 11.

Terminal 90 is connected to probe 24. Probe 24 includes a trigger coil inductor 25 which is simply a coil of wire which receives the signal at terminal 90. With the ignition switch 33 of the electronic ignition system closed, the ignition system is ready to fire, but requires engine rotation to periodically ground the input of ECU 12. In other words, as explained previously, sensor 11 senses the rotation of the timing cam in distributor 10 and applies a signal to ECU 12 over lines 17. By placing probe 24 in close physical proximity to distributor 10, sensor 11 will receive the same signal as if the timing cam in distributor 10 were rotating. Thus, probe 24 can be used to dynamically energize sensor 11, causing sensor 11 to transmit a signal, shown as waveform 91 in FIG. 3(*i*), over lines 17 to ECU 12, virtually the identical signal that ECU 12 would receive if the engine were operating. Thus, for all practical purposes, ECU 12 believes that the engine is operating and fires coil 14 accordingly.

Spark plug 30 will permit the mechanic to visually and audibly monitor the operation of the electronic ignition system. In other words, with probe 24 positioned as just described, ECU 12 can be operated over the entire RPM range by adjusting RPM knob 29. If the system is operating properly, spark plug 30 will fire and this can be sensed both visually and audibly. A problem at a particular speed can then be sensed as knob 29 varies the speed. On the other hand, if spark plug 30 does not fire, it is clear that there is a problem within ECU 12 or coil 14.

The output of OR gate 75 on line 84 is amplified and inverted by an amplifier 92. The output of amplifier 92 is applied to an output terminal 95 via a wave shaping circuit 94. Circuit 94 takes the 1/6 duty cycle square wave and creates a spike waveform 96 shown in FIG. 3(*k*) that has both a positive and negative polarity when referenced to ground.

The output of testing apparatus 20 at terminal 95 is used to drive ECU 12 or coil 14 directly in the event that the previous test shows a mulfunction. In other words, if, as a result of operation of testing apparatus 20, the electronic ignition system does not operate properly, the problem can either be in ECU 12 or in coil 14. Therefore, the output signal at terminal 95 can be applied to ECU 12 or coil 14 directly. If, for example, a signal is applied to ECU 12 and the system doesn't operate, the problem can either be in ECU 12 or in coil 14. If the signal is then applied to coil 14 and the system operates, then the problem is in ECU 12. On the other hand, if the system still does not operate, the problem is probably in coil 14.

The digitally controlled duty cycle achieved by means of counters 72 and 73 and OR gates 74 and 75 creates several advantages. Not only do these circuits provide a constant duty cycle with varying input duty cycles, thereby eliminating adjustments as required heretofor, but these elements reduce the output frequency to 1/12th of the input frequency, also as described previously. This allows pulse generator 45 to operate at a much higher frequency, resulting in smaller and less expensive components. Additionally, this higher frequency, even when passed through the appropriate divider 51–57 for monitoring on meter 71, allows the use of smaller and less expensive components in converter 70 and/or better filtering of the voltage to meter 71, resulting in little or no noticeable meter needle vibration, even at lower readings on the scale.

The digitally controlled duty cycle circuit described above uses dividers 72 and 73 that can be expanded to virtually any requirement. For example, a divide-by-eight counter could provide $\frac{1}{8}$, $\frac{1}{4}$, $\frac{3}{8}$, $\frac{1}{2}$, $\frac{5}{8}$, $\frac{3}{4}$, or $\frac{7}{8}$th duty cycles, either singly or in combination. This method can be very useful when testing circuits that use very short duty cycle pulse generated input signals. For example, an electrical tachometer that uses a Hall device/magnet or photo cell/light beam system at the input may have a duty cycle of only 5%. When such a unit has an input filtering network due to a noisy electrical environment, it can only be tested accurately at that duty cycle. In such a case, a signal generator followed by a divide-by-twenty counter would make a simple, but very accurate tester for such an instrument.

It can, therefore, be seen that the present invention differs from all prior known devices because it does not simulate operation of any component within the engine's electrical system. Rather, the present invention operates the electronic ignition system by dynamically exciting the magnetic or other sensor of the distributor so that the sensor generates pulses for application to the electronic control unit as if the engine were actually running. With such a system, no disconnection of parts or simulation of operation is required and an electronic ignition system can be operated over any RPM range, at any rate, and with any number of cylinders in operation.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. Testing apparatus for an electronic ignition system for an internal combustion engine, such electronic ignition system having an ignition coil with a spark output, an electronic control unit connected to said coil for controlling said coil output, a distributor, and a sensor coupled to said distributor and to said electronic control unit and responsive to rotation of a timing cam for producing output pulses for controlling said electronic control unit operation, comprising:

means for generating pulses at a desired rate; and means responsive to said pulse generating means for exciting said distributor sensor whereby said sensor generates pulses for controlling said electronic control unit operation.

2. Testing apparatus according to claim 1, wherein said distributor sensor is a magnetic sensor and wherein said exciting means comprises:

a coil.

3. Testing apparatus according to claim 1 or 2, further comprising:

means for adjusting the frequency of said pulse generating means.

4. Testing apparatus according to claim 1, wherein said sensor exciting means comprises:

means responsive to said pulse generating means for dividing the frequency of said pulses and adjusting the duty cycle thereof.

5. Testing apparatus according to claim 4, wherein said sensor exciting means further comprises:

means responsive to said frequency dividing and duty cycle adjusting means for generating a signal simulating the signal seen by said distributor sensor during rotation of said timing cam; and probe means responsive to said simulated signal and positionable adjacent said sensor for exciting said sensor.

6. Testing apparatus according to claim 5, wherein said sensor is a magnetic sensor and said probe means includes a coil.

7. Testing apparatus according to claim 4, 5 or 6, further comprising:

divider means responsive to said pulse generating means for dividing the output thereof into multiple, different frequency outputs;

switch means responsive to said divider means for selecting one of the outputs thereof;

converter means responsive to said switch means for converting the selected frequency into a voltage proportional thereto; and display means responsive to said converter means for visually displaying a representation of said selected frequency.

* * * * *